US011260676B2

(12) United States Patent
Räisänen et al.

(10) Patent No.: US 11,260,676 B2
(45) Date of Patent: Mar. 1, 2022

(54) MEDIA CONDITIONING

(71) Applicant: HEWLETT-PACKARD DEVELOPMENT COMPANY, L.P., Spring, TX (US)

(72) Inventors: Matthew Räisänen, Vancouver, WA (US); Stephen Thomas Rohman, Vancouver, WA (US); Kevin Lo, Vancouver, WA (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/499,961

(22) PCT Filed: Jun. 8, 2018

(86) PCT No.: PCT/US2018/036599

§ 371 (c)(1),
(2) Date: Oct. 1, 2019

(87) PCT Pub. No.: WO2019/236097

PCT Pub. Date: Dec. 12, 2019

(65) Prior Publication Data

US 2021/0323323 A1 Oct. 21, 2021

(51) Int. Cl.

| | |
|---|---|
| ***B41F 23/04*** | (2006.01) |
| ***B41J 29/38*** | (2006.01) |
| ***B41J 11/00*** | (2006.01) |
| ***B41J 13/02*** | (2006.01) |
| ***B41J 29/393*** | (2006.01) |

(52) U.S. Cl.
CPC ..... *B41J 11/00242* (2021.01); *B41F 23/0443* (2013.01); *B41J 13/02* (2013.01); *B41J 29/393* (2013.01)

(58) Field of Classification Search
CPC .... B41J 11/00242; B41J 13/02; B41J 29/393; B41J 11/0005; B41J 11/0015; B41F 23/0443; G03G 21/20; G03G 15/6573; G03G 2215/00666; G03G 2215/00949; G03G 15/6576; B65H 2301/51432;
(Continued)

(56) References Cited

U.S. PATENT DOCUMENTS

| | | | |
|---|---|---|---|
| 5,214,442 | A | 5/1993 | Roller |
| 6,536,863 | B1 | 3/2003 | Beauchamp et al. |

(Continued)

FOREIGN PATENT DOCUMENTS

| | | |
|---|---|---|
| EP | 0489366 B1 | 10/1995 |
| GB | 2353761 B | 2/2003 |

(Continued)

*Primary Examiner* — Huan H Tran
(74) *Attorney, Agent, or Firm* — Trop Pruner & Hu PC

(57) ABSTRACT

In some examples, a conditioner system for a media printed by a printing system includes a media conditioning assembly comprising a heater, the media conditioning assembly to receive the media printed by the printing system after the media has been heated by a dryer in the printing system after printing has occurred on the media. Responsive to a determined moisture content of the media, the heater of the media conditioning assembly controls a temperature of the media, and the media conditioning assembly controls a speed of the media through the media conditioning assembly.

15 Claims, 5 Drawing Sheets

(58) Field of Classification Search
CPC ..... B65H 2301/517; B65H 2404/147; B65H 2515/40; B65H 23/192
See application file for complete search history.

(56) References Cited

U.S. PATENT DOCUMENTS

| | | | | |
|---|---|---|---|---|
| 7,538,299 | B2 | 5/2009 | Spence et al. | |
| 8,038,280 | B2 | 10/2011 | Scarlata | |
| 8,959,792 | B2 | 2/2015 | Walker et al. | |
| 8,985,756 | B2 | 3/2015 | Boland et al. | |
| 9,327,524 | B1 * | 5/2016 | Yamada | B41J 11/00216 |
| 9,519,447 | B2 | 12/2016 | Huijbers et al. | |
| 2009/0184987 | A1 | 7/2009 | Shinkawa | |
| 2011/0279612 | A1 * | 11/2011 | Muro | B41J 11/0022 347/102 |
| 2012/0050433 | A1 * | 3/2012 | Fujikura | B41J 11/0024 347/102 |
| 2014/0047731 | A1 | 2/2014 | Quirk et al. | |
| 2014/0204158 | A1 * | 7/2014 | Emamjomeh | B41J 11/425 347/102 |
| 2015/0043998 | A1 * | 2/2015 | Janssen | B41F 23/02 412/33 |
| 2016/0114600 | A1 * | 4/2016 | Yamada | B41J 11/002 347/16 |

FOREIGN PATENT DOCUMENTS

| | | | | |
|---|---|---|---|---|
| JP | 2000255053 | A | 9/2000 | |
| JP | 2009-012414 | * | 1/2009 | B41J 2/01 |
| WO | WO2017095417 | A1 | 6/2017 | |

* cited by examiner

MEDIA CONDITIONING

BACKGROUND

A printing system prints images onto media. The printing system includes an imaging assembly that includes a printhead (or multiple printheads) through which printing liquid(s) can be dispensed onto a media.

BRIEF DESCRIPTION OF THE DRAWINGS

Some implementations of the present disclosure are described with respect to the following figures.

Figure 1A:
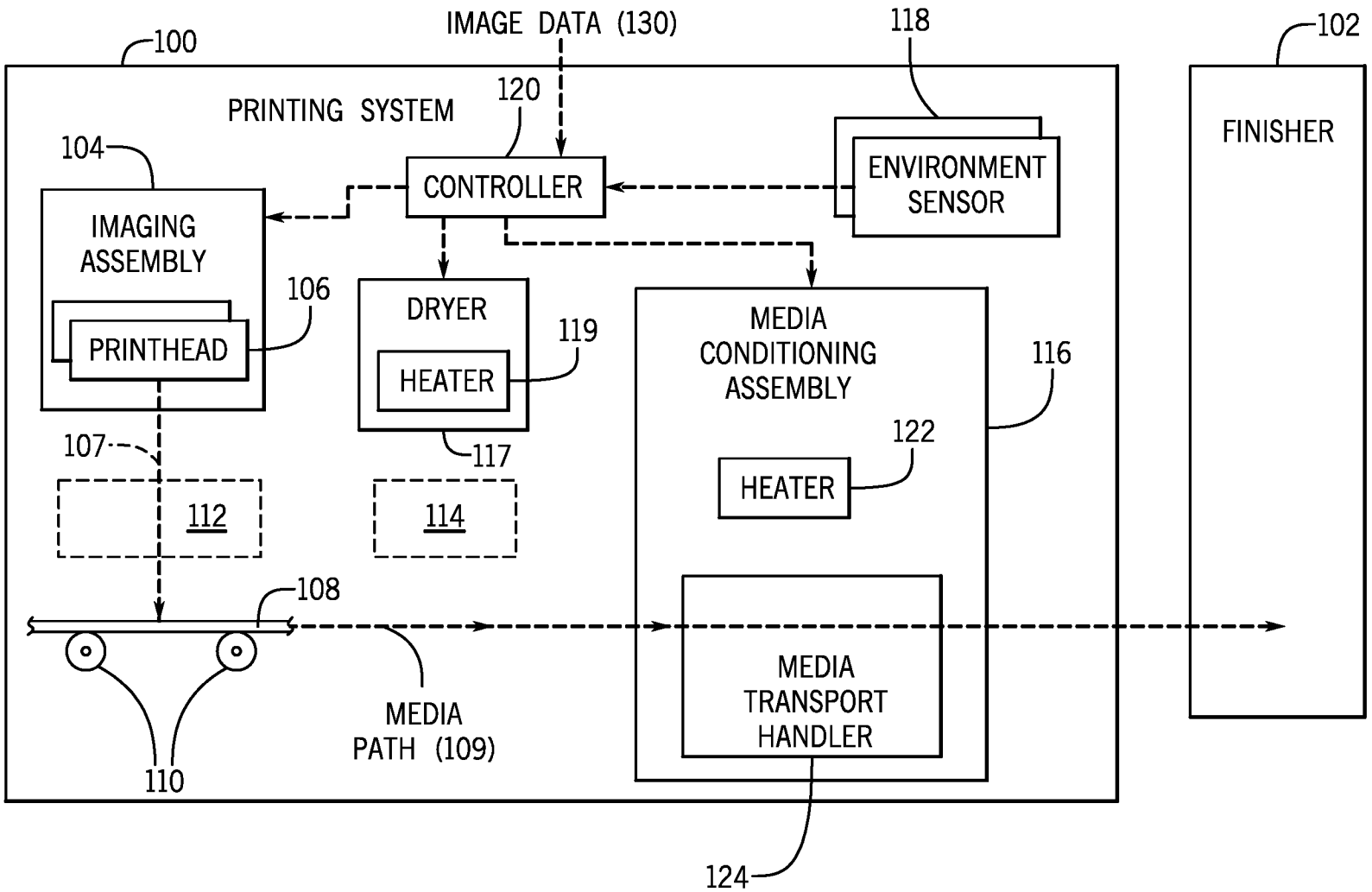
FIG. 1A is a block diagram of an arrangement including a printing system and a finisher, in accordance with some examples.

Throughout the drawings, identical reference numbers designate similar, but not necessarily identical, elements. The figures are not necessarily to scale, and the size of some parts may be exaggerated to more clearly illustrate the example shown. Moreover, the drawings provide examples and/or implementations consistent with the description; however, the description is not limited to the examples and/or implementations provided in the drawings.

DETAILED DESCRIPTION

In the present disclosure, use of the term "a," "an", or "the" is intended to include the plural forms as well, unless the context clearly indicates otherwise. Also, the term "includes," "including," "comprises," "comprising," "have," or "having" when used in this disclosure specifies the presence of the stated elements, but do not preclude the presence or addition of other elements.

When a printing liquid is printed onto a surface of a media in a printing system, a property of the media can change. A "media" can refer to a substrate of any type of material, including paper, plastic, fabric, metal, polymer, and so forth. The printing liquid when deposited onto the surface of the media can increase the moisture content of the media. In addition, the printing liquid can cause fibers of the media to swell, which can curl the media, create a higher surface friction on the media, and so forth. The curling of the media can cause the media to deviate from a target shape. Increased surface friction of the media can cause issues with transport of the media through the printing system, since the media is passed through media handlers (e.g., rollers or any other mechanisms used to move the media through the printing system).

Additionally, conditions of an environment of the printing system can also affect the moisture content of the media. For example, the moisture content can increase if the environment is cold and/or humid.

If the media is to be output to a finisher, then the finisher may not operate properly if the shape or other condition of the media deviates from a target shape or condition. In some examples, a finisher can be used to perform any or some combination of the following: compiling sheets of media, stapling sheets of media, de-curling sheets of media, making a booklet from sheets of media, and so forth.

In accordance with some implementations, of the present disclosure, a media conditioning assembly is provided to condition a media after the media has been printed by a printing system and after drying by a dryer in the printing system. The media conditioning assembly includes a heater and a media transport handler that are able to control, based on a determined moisture of a media, a temperature of the media and a speed of the media passing through the media conditioning assembly. In some examples, the control of the conditioning temperature of the media (in the media conditioning assembly) and/or the control of the speed of the media in the media conditioning assembly can be performed independently of temperatures and speeds of the media in the printing system.

FIG. 1A is a block diagram of an example arrangement that includes a printing system 100 and a finisher 102. A "printing system" refers to any system that can form an image onto a media. An "image" that can be formed onto the media can include any combination of text and/or graphics that can be formed on the media based on dispensing printing liquid(s) onto the media.

The finisher 102 can be used to perform any or some combination of the following: compiling sheets of media, stapling sheets of media, de-curling sheets of media, making a booklet from sheets of media, and so forth.

The printing system 100 includes an imaging assembly 104 that includes a printhead 106 (or multiple printheads). A printhead 106 is used to deliver a printing liquid 107 through nozzles of the printhead 106 to a media 108 in a print zone 112 as part of a printing process to form an image on the media 108.

The printing system 100 includes a transport mechanism 110 to transport the media 108 through the printing system 100. In some examples, the transport mechanism 110 can include rollers that are able to guide the media 108 along a path in the printing system 100 during the printing process. In other examples, the transport mechanism 110 can include a moveable belt or other components that are able to carry the media 108 along a path.

After the printhead(s) 106 of the imaging assembly 104 has (have) provided printing liquid(s) onto the media 108 in the print zone 112, the transport mechanism 110 can direct the media 108 (along a path 109) to a drying zone 114 of the printing system 100. In the drying zone 114, a dryer 117 applies heat to the media 108 to dry the media 108. Drying of the media 108 can aid in fixing the image onto the media 108. The dryer 117 includes a heater 119 (or multiple heaters). A heater can include an infrared lamp, or any other type of unit that when activated generates heat.

Although not shown, the dryer 117 can also include an airflow generator (e.g., a fan) that can direct a flow of air to assist in drying the media 108.

After the drying of the media 108 that has been performed by the dryer 117, the media 108 can be directed by the transport mechanism 110 further along the path 109 to a media conditioning assembly 116. The media conditioning assembly 116 is used to condition the media further to allow for a shape or other condition of the media 108 to be controlled based on a determined moisture content of the media 108.

The moisture content of the media 108 can be based on a number of factors. The moisture content of the media 108 can be based on a printing liquid content on the media 108

(i.e., the amount of printing liquid dispensed by the imaging assembly 104 onto the media 108 as part of the printing process).

The moisture content of the media 108 can also be based on an environment of the printing system 100, including the environment that is within the printing system 100 (i.e., within the outer housing of the printing system 100) and/or the environment that is external of the printing system 100. A characteristic of the environment of the printing system 100 (which includes the environment within the printing system 100 and/or the environment outside the printing system 100) can include a temperature of the environment, a humidity of the environment, and so forth. A wet and/or cold environment can lead to an increased moisture content of the media 108. For example, a wet environment (i.e., an environment with higher humidity) can mean that evaporation of printing liquid from the media 108 is slower to occur. Similarly, a cold environment (i.e., an environment with a lower temperature) can also mean that printing liquid is slower to evaporate from the media 108.

The printing system 100 includes environment sensors 118 to measure characteristics of the environment of the printing system 100. The environment sensors 118 can include a temperature sensor and a humidity sensor, in some examples. The temperature sensor measures a temperature of the environment of the printing system 100, and the humidity sensor measures a humidity of the environment of the printing system 100. In other examples, additional or alternative environment sensors 118 can be used to measure other characteristics of the environment of the printing system 100.

Although multiple environment sensors 118 are shown in the example of FIG. 1A, it is noted that in other examples, the printing system 100 can include just one environment sensor 118, such as to measure a temperature or humidity of the environment.

The output of the environment sensors 118 can be provided to a controller 120. As used here, a "controller" can refer to a hardware processing circuit, which includes any or some combination of the following: a microprocessor, a core of a multi-core microprocessor, a microcontroller, a programmable integrated circuit device, a programmable gate array, or any other hardware processing circuit. In other examples, a "controller" can include a combination of a hardware processing circuit and machine-readable instructions (software and/or firmware) executable on the hardware processing circuit.

The controller 120 can control operations of the imaging assembly 104, the dryer 117, and the media conditioning assembly 116. In other examples, separate controllers can be used to control the imaging assembly 104, the dryer 117, and the media conditioning assembly 116.

The media conditioning assembly 116 includes a heater 122 (or multiple heaters) and a media transport handler 124. The heater(s) 122 can be controlled by the controller 120 to adjust the conditioning temperature in the media conditioning assembly 116 to perform further conditioning of the media 108 to account for the moisture content of the media 108. The media transport handler 124 can control the speed of the media 108 through the media conditioning assembly 116.

The heating performed by the heater(s) 122 of the media conditioning assembly 116 is in addition to heating applied by the heater(s) 119 of the dryer 117. In some examples, the dryer 117 has a finite capacity such that the dryer 117 is unable to perform the appropriate conditioning on the media 108 to maintain the media 108 at a target shape or other condition, even if the media 108 is transported through the drying zone 114 at a slower speed. As a result, use of the dryer 117 may not be practical for performing media conditioning if high-speed printing is desired, in which the media 108 is transported through the printing system 100 at a relatively high speed during the printing process. As used here, a "printing process" can refer to imaging to be performed by the imaging assembly 104, and further processing such as processing performed by the dryer 117 (and any other assemblies not shown).

By including the media conditioning assembly 116 in the printing system 100, conditioning of the media 108 can be performed to ensure that the media 108 has a shape or other condition that is suitable for finishing by the finisher 102.

Additionally, by being able to condition the media 108 in the media conditioning assembly 116 after printing by the imaging assembly 104, transfer of a printing liquid from the media to other components (e.g., media guides, rollers, etc.) of the printing system 100 can be reduced. The transfer of a printing liquid from the media to other components can cause smearing of other media when the other media are passed through the other components.

Although FIG. 1A shows the media conditioning assembly 116 as being part of the printing system 100, it is noted that in further examples, the media conditioning assembly 116 can be separate from the printing system 100. For example, the media controller assembly 116 can be disposed between the printing system 100 and the finisher 102. In yet further examples, the media conditioning assembly 116 can be included as part of the finisher 102.

In some examples, the control of the heating to be applied by the heater(s) 122 of the media conditioning assembly 116 can be independent of the control of the heating to be applied by other heater(s) (such as the heater(s) 119 of the dryer 117) in the printing system 100. Similarly, the control of the speed of the media 108 by the media transport handler 124 in the media conditioning assembly 116 can be independent of speed of the media 108 elsewhere in the printing system 100, such as the speed controlled by the media transport mechanism 110 of the printing system 100.

By being able to independently control the temperature and speed of the media 108 in the media conditioning assembly 116, more control over the conditioning of the media 108 can be achieved.

The controller 120 receives image data 130 that represents the image to be printed onto the media 108. The controller 120 can analyze the image data 130 to estimate the amount of printing liquid(s) to be dispensed onto the media 108. Based on the estimated amount of printing liquid that is to be dispensed onto the media 108, the controller 120 can control heating applied by the heater(s) 122 of the media conditioning assembly 116, and a speed of travel of the media 108 through the media conditioning assembly 116.

As noted above, the controller 120 also receives a measured characteristic (or measured characteristics) from the corresponding environment sensor(s) 118, such that the controller 120 can control heating applied by the media conditioning assembly 116 and the speed of travel of the media 108 in the media conditioning assembly 116 based on the measured environment characteristic(s).

By being able to vary the conditioning temperature and the media speed of the media conditioning assembly 116, the moisture content of the media 108, media curl, and media surface friction can be adjusted to deliver the media 108 in a condition that can be successfully finished by the finisher 102.

The following describes example scenarios and how the controller 120 can control the conditioning temperature and the media speed of the media conditioning assembly 116 in such scenarios. If the amount of printing liquid to be dispensed onto the media 108 is low (e.g., below a first threshold), then the media 108 can be run at a higher speed and with a lower conditioning temperature through the media conditioning assembly 116. In this scenario where the amount of printing liquid to be dispensed is low, if the media 108 is run too slowly through the media conditioning assembly 116 or if the conditioning temperature in the media conditioning assembly 116 is set too high, then the media 108 can become over-dried, which can create media curl that can adversely affect the operation of the finisher 102.

In another example scenario, if the amount of printing liquid to be dispensed onto the media 108 is a medium amount (e.g., greater than the first threshold but less than a second threshold), then the controller 120 can control the media conditioning assembly 116 to run the media 108 through the media conditioning assembly 116 at a medium speed and at a higher conditioning temperature. If the media 108 is run too slowly and set at too high a conditioning temperature in the media conditioning assembly 116, then the media 108 can become over-dried. On the other hand, if the media 108 is transported at too high a speed and set at too low a conditioning temperature in the media conditioning assembly 116, then the media 108 can become under-dried, which can also create excessive media curl, high moisture content, and high media surface friction.

In a further example scenario, if the amount of printing liquid to be dispensed onto the media 108 is high (e.g., greater than the second threshold), then the controller 120 can control the media conditioning assembly 116 to transport the media 108 at a slower speed and at a higher conditioning temperature in the media conditioning assembly 116. If the media 108 is transported at too high a speed or at too low a conditioning temperature in the media conditioning assembly 116, then the media 108 can be under-dried.

Although reference is made to three discrete levels (low, medium, and high) of printing liquid to be dispensed and the control of the media conditioning assembly 116 for the three discrete levels, it is noted that in other examples, the control of the media conditioning assembly 116 can be based on corresponding continuous amounts of printing liquid to be dispensed.

The foregoing refers to controlling the media conditioning assembly 116 based on the amount of printing liquid(s) to be dispensed onto the media 108. In further examples, the control of the media conditioning assembly 116 can additionally or alternatively be based on the detected environment of the printing system 100, as indicated by outputs of the environment sensors 118.

In alternative examples, the media conditioning assembly 116 can also be used in printing systems that do not employ printing liquids. For example, a laser printing system uses a toner on media. Techniques or mechanisms according to some implementations of the present disclosure can also be applied in such other printing systems that do not employ printing liquids. In such printing systems, the control of the media conditioning assembly 116 can be based on the detected characteristic(s) of the media 108 that provides an indication of the moisture content of the media 108.

Figure 1B:
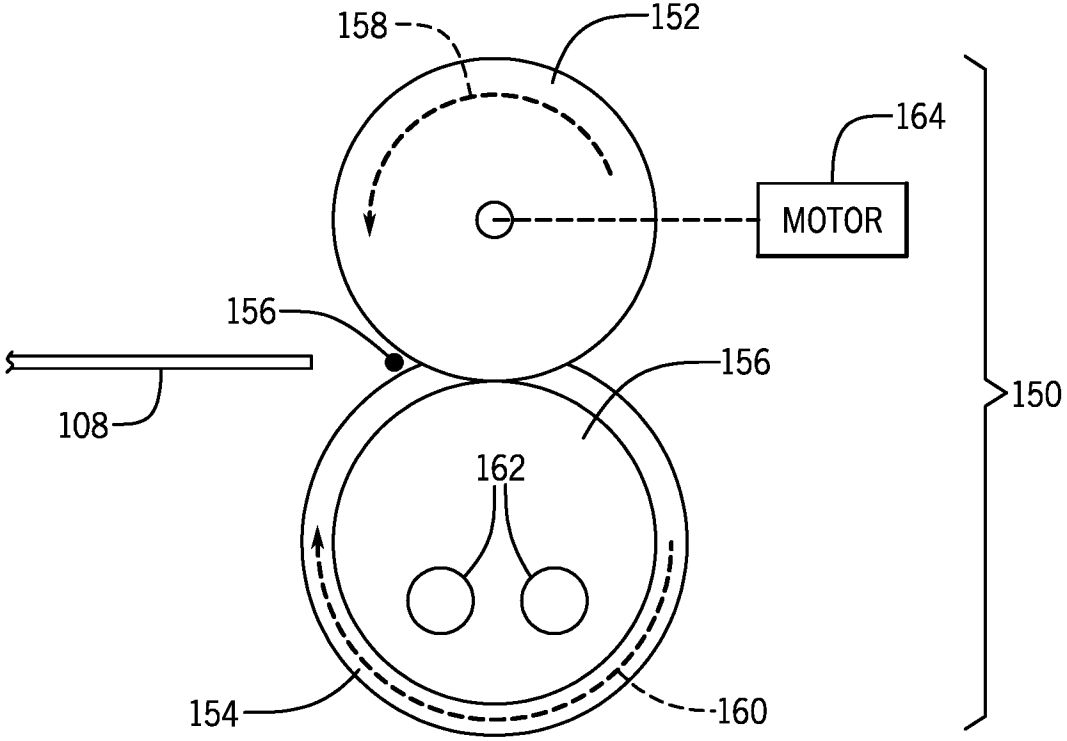
FIG. 1B is a block diagram of a media conditioning assembly according to some examples.

FIG. 1B shows an example of a media conditioning assembly 150 in which a heater and a media transport handler are implemented using rollers 152 and 154. In some examples, the roller 154 can be implemented as a belt formed of a deformable material (e.g., steel, a polymer film, etc.). In other examples, the roller 154 can be a solid roller.

The combination of the rollers 152 and 154 form a heated pressure roller assembly. A nip 156 is provided between the rollers 152 and 154. The media 108 is received in the nip 156, and passes between the rollers 152 and 154 as the rollers rotate in respective rotational directions 158 and 160.

Heaters 162 (e.g., infrared lamps) are provided in a space inside the roller 154 to heat the roller 154. Although two heaters 162 are shown in FIG. 1A, it is noted that in other examples, a different number (one or greater than two) of heaters can be used.

The heaters 162 heat the roller 154, which in turn heats the media 108 to a conditioning temperature when the media 108 passes between the rollers 152 and 154.

The roller 152 can be attached to a motor 164, which can rotate the roller 152. Varying the rotational speed of the roller 152 (such as based on commands from the controller 120 of FIG. 1A) can control the speed at which the media 108 passes through the media conditioning assembly 150.

Although FIG. 1B shows the roller 154 as being heated while the roller 152 is driven by the motor 164, in other examples, the same roller can both be heated and driven by a motor, or alternatively, both rollers 152 and 154 can be heated and driven by a motor (or multiple motors).

A benefit of using the heated pressure roller assembly as shown in FIG. 1B is that the media 108 can be constrained (between the rollers 152 and 154) as the media 108 is being dried, which helps reduce media cockling (planar distortion of the media that can appear as wrinkles, puckers or ripples). Moreover, the heated pressure roller assembly applies heat to the media 108 by conduction. The heated pressure roller assembly also compresses the media 108, which helps reduce the surface friction of the media 108.

Figure 2A:
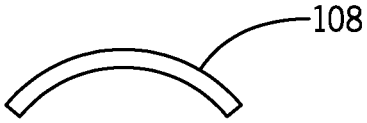
FIGS. 2A-2C illustrate target shapes of media to be set by a media conditioning assembly according to some examples.
Figure 2B:
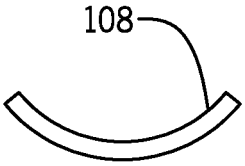

For different types of finishers 102 or different finishings to be applied by the finisher 102, a target shape of the media 108 to be maintained for optimal performance of the finisher 102 can be different. For example, in some cases, the target shape of the media 108 is a flat shape, which means that the media 108 remains generally planar. In other examples, the target shape of the media 108 can generally be a U-shape, such as shown in FIG. 2A or 2B. FIG. 2A shows the U-shape as being a generally upside-down U, such that when viewed from the top, the media 108 is convex. FIG. 2B shows the media 108 as being generally a U, such that when viewed from the top, the media 108 has a concave shape.

Figure 2C:
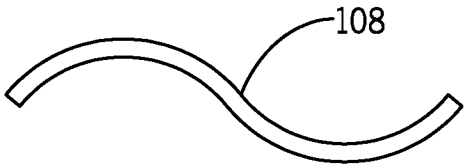

As another example, the target shape of the media 108 can be a general S-shape, such as shown in FIG. 2C.

In other examples, other target shapes of the media 108 can be provided by the media conditioning assembly 116.

Figure 3:
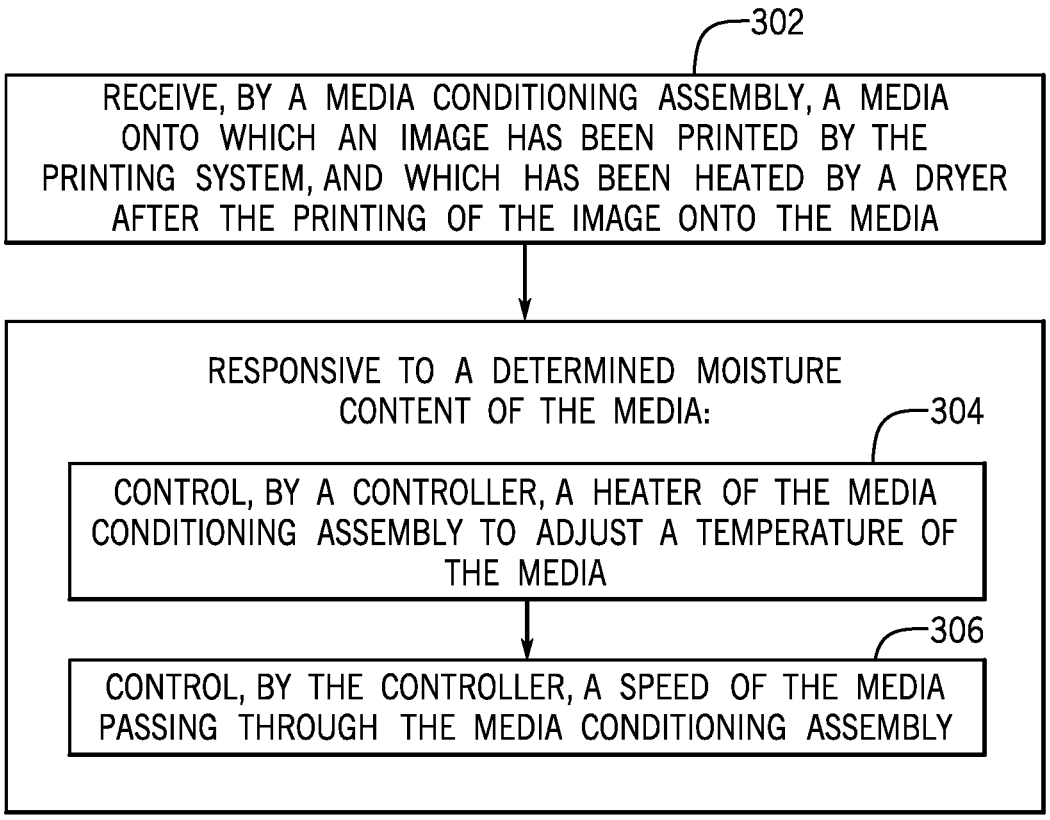
FIG. 3 is a flow diagram of a process according to some examples.

FIG. 3 is a flow diagram of a process according to some implementations, which can be performed in the printing system 100 of FIG. 1A, for example. A media conditioning assembly (e.g., 116 in FIG. 1A) receives (at 302) a media onto which an image has been printed by the printing system 100, and which has been heated by a dryer (e.g., 117) after the printing of the image onto the media.

Responsive to a determined moisture content of the media (which can be based on the amount of printing liquid dispensed onto the media and/or the environment of the printing system 100), a controller (e.g., 120 in FIG. 1A) controls (at 304) a heater of the media conditioning assembly to adjust a temperature of the media, and controls (at 306) a speed of the media passing through the media conditioning assembly.

Figure 4:
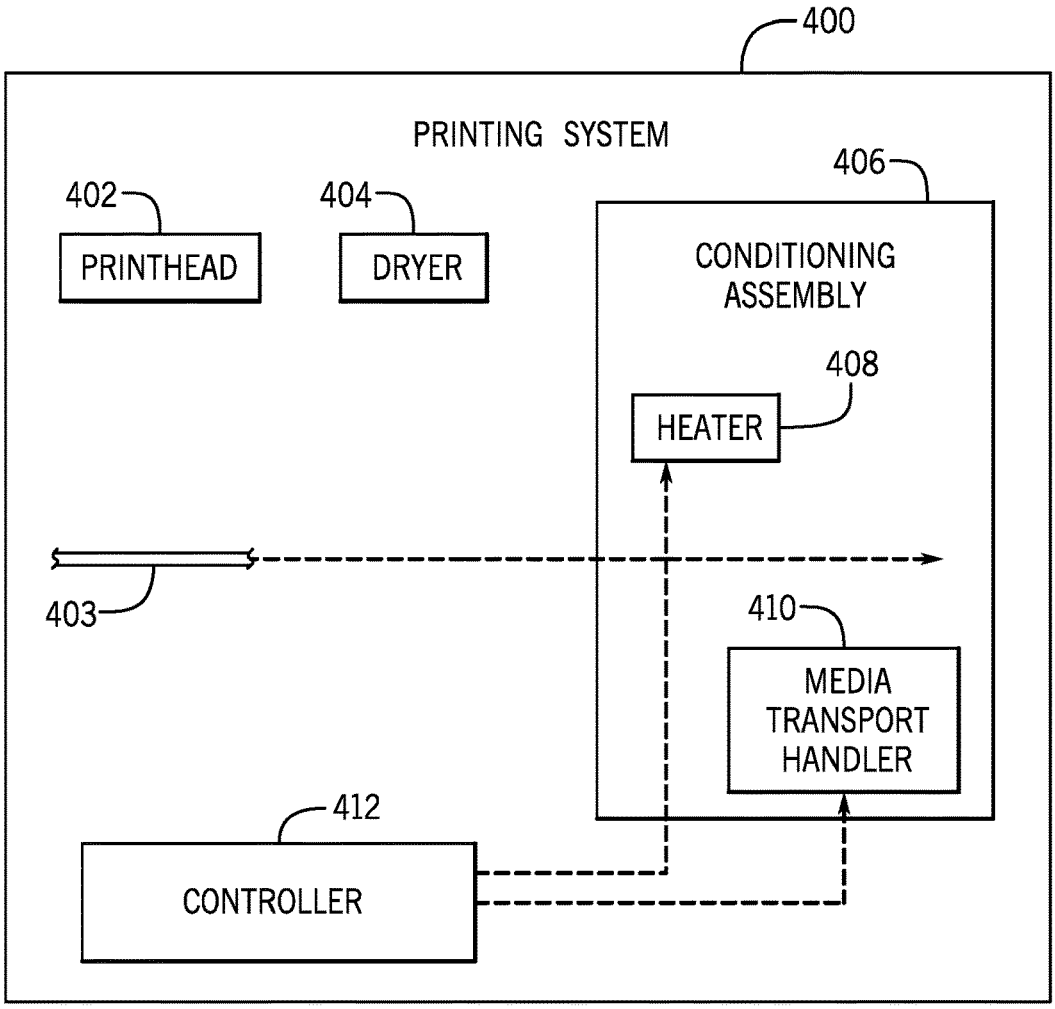
FIG. 4 is a block diagram of a printing system according to further examples.

FIG. 4 is a block diagram of a printing system 400 according to further examples. The printing system 400 includes a printhead 402 to print an image onto a media 403, a dryer 404 to heat the media after the printing of the image onto the media, and a conditioning assembly 406 downstream of the dryer 404.

The conditioning assembly 406 includes a heater 408 and a media transport handler 410. The media handling assembly 406 receives the media printed by the printhead 402 after the media has been heated by the dryer 404 after the printing.

The printing system 400 further includes a controller 412 to, responsive to a determined moisture content of the media, control the heater 408 to adjust a conditioning temperature of the media 403 in the conditioning assembly 406, and the media transport handler 410 to vary a speed of the media 403 through the conditioning assembly 406.

Figure 5:
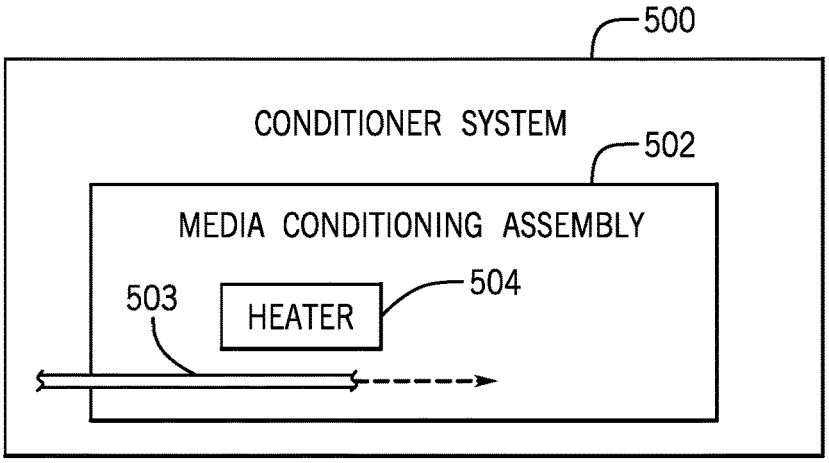
FIG. 5 is a block diagram of a conditioner system for a media printed by a printing system, according to some examples.

FIG. 5 is a block diagram of a conditioner system 500 for a media 503 printed by a printing system. The conditioner system 500 can be part of or separate from the printing system. The conditioner system 500 includes a media conditioning assembly 502. The media conditioning assembly 502 includes a heater 504.

The media conditioning assembly 502 receives the media 503 printed by the printing system after the media 503 has been heated by a dryer in the printing system after printing has occurred on the media 503. Responsive to a determined moisture content of the media, the heater 504 of the media conditioning assembly 502 controls a temperature of the media 503, and the media conditioning assembly 502 controls a speed of the media 503 through the media conditioning assembly 502.

As noted above, in some examples, the controller 120 (FIG. 1A) or 412 (FIG. 4) can be implemented as a combination of a hardware processing circuit and machine-readable instructions executable on the hardware processing circuit.

In such examples, the machine-readable instructions can be stored on a non-transitory machine-readable or computer-readable storage medium, which can include any or some combination of the following: a semiconductor memory device such as a dynamic or static random access memory (a DRAM or SRAM), an erasable and programmable read-only memory (EPROM), an electrically erasable and programmable read-only memory (EEPROM) and flash memory; a magnetic disk such as a fixed, floppy and removable disk; another magnetic medium including tape; an optical medium such as a compact disk (CD) or a digital video disk (DVD); or another type of storage device. Note that the instructions discussed above can be provided on one computer-readable or machine-readable storage medium, or alternatively, can be provided on multiple computer-readable or machine-readable storage media distributed in a large system having possibly plural nodes. Such computer-readable or machine-readable storage medium or media is (are) considered to be part of an article (or article of manufacture). An article or article of manufacture can refer to any manufactured single component or multiple components. The storage medium or media can be located either in the machine running the machine-readable instructions, or located at a remote site (e.g., a cloud) from which machine-readable instructions can be downloaded over a network for execution.

In the foregoing description, numerous details are set forth to provide an understanding of the subject disclosed herein. However, implementations may be practiced without some of these details. Other implementations may include modifications and variations from the details discussed above. It is intended that the appended claims cover such modifications and variations.

What is claimed is:

1. A conditioner system for a media printed by a printing system, comprising:

a media conditioning assembly comprising a heater, the media conditioning assembly to receive the media printed by the printing system after the media has been heated by a dryer in the printing system after printing has occurred on the media, and, responsive to a determined moisture content of the media, the heater of the media conditioning assembly to control a temperature of the media and the media conditioning assembly to control a speed of the media through the media conditioning assembly.

2. The conditioner system of claim 1, wherein the determined moisture content of the media is based on a measured characteristic of an environment of the printing system.

3. The conditioner system of claim 2, wherein the measured characteristic of the environment is selected from a temperature and humidity of the environment.

4. The conditioner system of claim 2, wherein the determined moisture content of the media is based on a printing liquid content on the media.

5. The conditioner system of claim 1, wherein the control of the temperature of the media and the control of the speed of the media through the media conditioning assembly is to control a shape of the media prior to the media being provided to a media finisher.

6. The conditioner system of claim 5, wherein the control of the shape of the media comprises controlling the shape of the media to have a target shape selected from among a flat shape, a U shape, and an S shape.

7. The conditioner system of claim 1, wherein the media conditioning assembly comprises a first roller having an adjustable rotational speed to vary the speed of the media through the media conditioning assembly.

8. The conditioner system of claim 7, further comprising a second roller to interact with the first roller to transport the media through the media conditioning assembly, wherein the heater is to heat the first roller or the second roller.

9. A printing system comprising:

a printhead to print an image onto a media;

a dryer to heat the media after the printing of the image onto the media;

a conditioning assembly downstream of the dryer, the conditioning assembly comprising:

a heater and a media transport handler, the conditioning assembly to receive the media printed by the printhead after the media has been heated by the dryer after the printing; and a controller to, responsive to a determined moisture content of the media, control the heater to adjust a temperature of the media and the media transport handler to vary a speed of the media through the conditioning assembly.

10. The printing system of claim 9, wherein the controller is to control the heater to adjust the temperature of the media independently of a temperature used as part of a printing process in the printing system, and the controller is to control the media transport handler to vary the speed of the media through the conditioning assembly independent of a speed of the media during the printing process in the printing system.

11. The printing system of claim 9, wherein the controlling of the heater and the media transport handler responsive to the determined moisture content of the media is to achieve a target shape of the media, and wherein the conditioning assembly is to output the media shaped according to the target shape to a finisher.

12. The printing system of claim 9, wherein the media transport handler and the heater are part of a heated pressure roller assembly.

13. The printing system of claim 9, wherein the controller is to determine the moisture content of the media based on at least one selected from among:

the image to be printed onto the media, or a measured characteristic, from a sensor, of the environment of the printing system.

14. A method comprising:

receiving, by a media conditioning assembly, a media onto which an image has been printed by a printing system, and which has been heated by a dryer after the printing of the image onto the media; and responsive to a determined moisture content of the media:

controlling a heater of the media conditioning assembly to adjust a temperature of the media, and controlling a speed of the media passing through the media conditioning assembly.

15. The method of claim 14, further comprising:

determining the moisture content of the media based on an amount of printing liquid to be printed onto the media and based on a measured characteristic of an environment of the printing system.

* * * * *